United States Patent [19]

Hemery

[11] Patent Number: 4,735,154

[45] Date of Patent: Apr. 5, 1988

[54] REINFORCED LOADING PALLET AND PROCESS FOR REINFORCING SAME

[75] Inventor: André Hemery, Les Andelys, France

[73] Assignee: Allibert S.A., Grenoble Cedex, France

[21] Appl. No.: 937,283

[22] Filed: Dec. 3, 1986

[30] Foreign Application Priority Data

Dec. 4, 1985 [FR] France ..... 85 17971

[51] Int. Cl.[4] ..... B65D 19/12

[52] U.S. Cl. ..... 108/56.1; 108/51.1

[58] Field of Search ..... 108/56.1, 56.3, 51.1, 108/901, 55.3, 51.3; 206/599, 600, 386

[56] References Cited

U.S. PATENT DOCUMENTS

| | | | |
|---|---|---|---|
| 2,463,622 | 3/1949 | Holet | 108/51.1 |
| 2,691,499 | 10/1954 | Watts | 108/56.3 X |
| 3,059,887 | 10/1962 | Ward, Jr. | 108/51.1 |
| 3,393,647 | 7/1968 | Howell | 108/51.1 |
| 3,438,342 | 4/1969 | Woolworth et al. | 108/56.3 |
| 3,650,225 | 3/1972 | Ball | 108/51.1 |
| 3,654,877 | 4/1972 | Barret | 108/56.1 |
| 3,664,271 | 5/1972 | Wolder et al. | 108/51.1 |
| 3,685,463 | 8/1972 | Francis | 108/56.3 |
| 3,722,430 | 3/1973 | Woodley et al. | 108/51.1 |
| 3,835,791 | 9/1974 | Brown | 108/56.3 X |
| 4,051,787 | 10/1977 | Nishitani et al. | 108/51.1 |
| 4,244,766 | 1/1981 | Yellen | 108/51.3 X |
| 4,267,781 | 5/1981 | Powers | 108/56.3 X |
| 4,580,680 | 4/1986 | Wind | 206/386 |
| 4,604,014 | 8/1986 | Frano | 108/56.3 X |

FOREIGN PATENT DOCUMENTS

| | | | |
|---|---|---|---|
| 101763 | 6/1925 | Austria | 108/56.1 |
| 68586 | 6/1982 | European Pat. Off. . | |
| 2111135 | 9/1972 | Fed. Rep. of Germany | 108/56.1 |
| 2215969 | 10/1973 | Fed. Rep. of Germany . | |
| 2231178 | 1/1974 | Fed. Rep. of Germany . | |
| 2387850 | 11/1978 | France . | |
| 7819878 | 3/1980 | France | 108/56.1 |
| 2503669 | 10/1982 | France . | |
| 58-81248 | 5/1983 | Japan | 108/51.1 |

*Primary Examiner*—Kenneth J. Dorner
*Assistant Examiner*—José V. Chen
*Attorney, Agent, or Firm*—Pollock, VandeSande & Priddy

[57] ABSTRACT

The invention involves a reinforced loading pallet and a processing for reinforcing same. Under the invention, with the pallet composed chiefly of two matching, superimposed panels each comprising a rigid framework equipped with ties channels are formed in some or all of the ties of at least one of the panels, and reinforcing rods (10) are inserted into said channels. The invention is applied notably to pallets for handling goods.

10 Claims, 2 Drawing Sheets

REINFORCED LOADING PALLET AND PROCESS FOR REINFORCING SAME

FIELD OF THE INVENTION

The purpose of the present invention is a process for reinforcing a molded plastic loading pallet composed primarily of two superposed, essentially rectangular matching panels, each comprising a rigid framework equipped with hollow, polygonal feet arranged at the four outer corners of said framework, and possibly at other points as well.

The process of the invention improves rigidity and load resistance over known loading pallets.

SUMMARY OF THE INVENTION

For this purpose, the process recommended by the invention is characterized by the fact that some or all of the ties in at least one of the frameworks are provided with channels into which reinforcing rods are inserted in a set order, and by the fact that some or all of said rods are locked together at their points of intersection.

Producing pallets in this way yields a structure with greater rigidity for a given weight and quantity of load.

The invention also involves a reinforced loading pallet produced using the abovementioned process, characterized by the fact that the framework of at least one of the panels is provided with channels, at least some of which meet in the same plane, and which are designed to accommodate said reinforcing rods, which extend within at least some of the ties of said framework.

According to another characteristic of the invention, molded plastic inserts are located between the feet of one panel's framework and the corresponding feet of the framework of the opposing panel. In this way, a load can be distributed to various points on the pallet, with the inserts acting as shock absorbers and load distributors.

In order to prevent a load from sliding over the surface of the pallet on which it is deployed, and to prevent said pallet from accidental movement when on the ground or loaded on a forklift, antiskid pads are provided. These are distributed over at least one outer surface of one of the panels and lock into appropriate lodgings.

The invention will be more readily apparent from the following description, which refers to the attached drawings, in which:

DETAILED DESCRIPTION OF THE INVENTION

Figure 1:
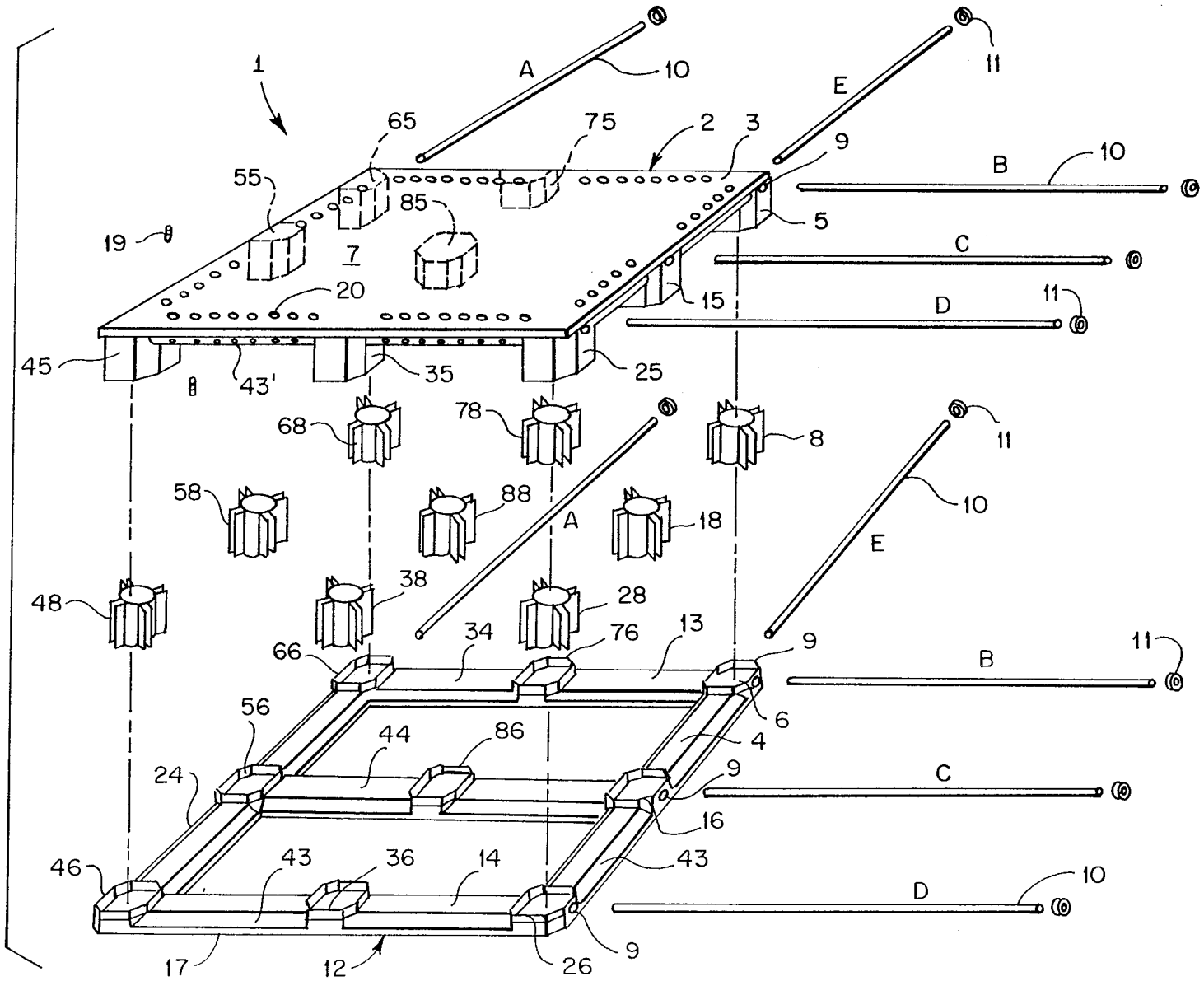
FIG. 1 is a view in perspective of the loading pallet and its component parts. It should be noted that the inserts have been represented schematically.

In the embodiment shown, a loading pallet designated overall by the FIG. 1 is composed of two essentially rectangular superimposed panels 2, 12. Each panel comprises a rigid framework 3, 13 composed of several ties 4, 14, 24, 34, 44. It will be noted that FIG. 1 shows only the ties (4, 14, etc.) making up framework 13 of lower panel 12. However, framework 3 of upper panel 2 is, in the embodiment chosen for representation here, formed in a similar way.

The ties may be closed sections. Hollow feet 5, 15, 25, 35, 45, 55, 65, 75, 85, which are essentially polygonal in shape, are set at the four outer corners of upper framework 3, and possibly at other points. The feet protrude from framework 3 on the side opposite the upper, outer surface 7 (loading surface) of upper panel 2. These feet fit over matching feet 6, 16, 26, . . . 86, on the surface opposite the lower, outer surface 17 (bearing surface) of framework 13 of matching panel 12. Thus the feet are joined together in pairs, such as 5–6, 15–16, 25–26, etc.

In addition, within and between each matched foot is a molded plastic insert 8, 18, 28, 38, 48, 58, . . . 88. These inserts will be described in more detail further on.

It will be noted that in the embodiment shown in FIG. 1, panels 2 and 12 have a similar structure. In particular, the foot pairs 5–6, 15–16, etc., between which inserts 8, 18, 28, etc., are held are located at the four outer corners of frameworks 3 and 13 of the panels; at the approximate midpoints of the four outer ties 4, 14, 24, 34, of each panel; and at the approximate midpoint of central cross-tie 44. However, lower panel 12 may differ from upper panel 2. In particular, it may not include reinforced lateral ties 4, 24 or a reinforced center tie 44. Similarly, the feet of upper panel 2 may protrude further than the matching feet of panel 12 with which they interact. The structure of each panel 2, 12 may obviously be adapted as a function of the load to be borne and the use for which the pallet is intended.

Referring still to FIG. 1, it will be noted that the two frameworks 3, 13 of panels 2, 12, respectively, are provided with channels 9 lying in a single plane and designed to accommodate straight, rigid reinforcing rods 10 extending through ties 4, 14, 24, etc. of the frameworks. These rods may be metal tubes, closed sections, or tubes with a noncircular cross-section. In order not to clutter the figure, only some of the rods and channels have been referenced.

Advantageously, channels 9 are closed at one end and essentially extend through the entire length of the ties of each of said frameworks. The rods and channels cross at essentially right angles at the peripheral intersecting feet (5, 15, 25, 35, 45, 55, 65; and 6, 16, 26, 36, 46, 56, 66), and open out onto only some of the lateral surfaces of said ties.

Although FIG. 1 shows the two panels (2, 12) as being identical and arranged in the same way, their respective arrangement could advantageously be switched, with middle rod 10 (reference C) of upper panel 2 being found between rods A and E of the same panel and extending into the corresponding reinforced tie.

In the embodiment shown, it will be noted that rods 10 are arrayed through channels 9 in ties 4, 14, etc., and extend under the feet of each panel. Inserts 8, 18, 28, etc., which fit into the corresponding feet, will therefore find themselves positioned between rods 10 when the two parts 2, 12 of the pallet are joined together.

Advantageously, channels 9 are essentially square in cross-section. Similarly, so as to prevent them from moving unintentionally within the channels, rods 10 have an essentially matching cross-section. They may have a cross-section that is essentially parallelopiped, either rectangular or square.

Furthermore, in order to hold rods 10 in place after they have been inserted into channels 9, the open ends of said channels are stoppered with plugs 11. Plugs 11 may be injection molded or welded into the open ends of said channels.

Referring still to the embodiment presented in FIG. 1, it will be noted that ties 4, 14, 24, etc. are bevelled in order to facilitate the insertion of the forks of a forklift. It will be noted that these bevels may appear as an elongated inclined surface or as a series of ribs 43' formed on the surfaces of framework 3, 13 that come into contact with said forks.

Figure 4:
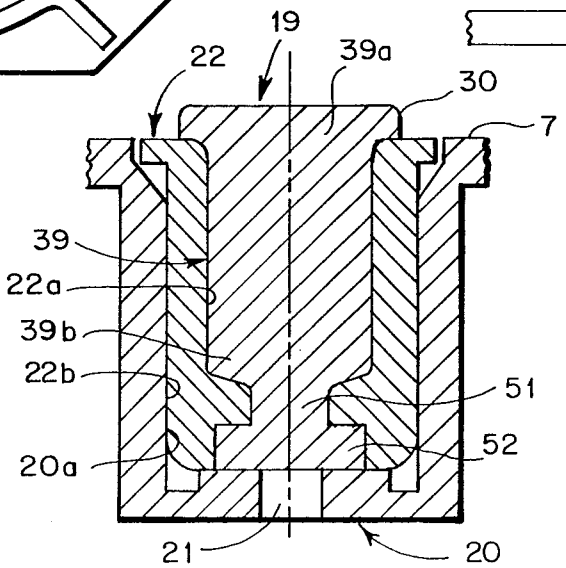
FIG. 4 is a cutaway side view of the antiskid pad in its lodging.

Referring now to FIG. 4, attention is drawn to anti-skid pads 19 distributed over some of the surfaces of panels 2, 12 of the pallet and partially contained within lodgings 20 provided for this purpose in said panels.

Pads 19 are advantageously composed of a rubbery center sole 39 which is relatively flexible and skid-resistant, and a relatively rigid outer sleeve 22. The rigidity of the latter element facilitates the installation of the pad and helps hold it fast in its lodging.

Center sole 39 may be molded into sleeve 22 in such a way that during the molding process barrel **39*b* of the sole will be locked tightly within the corresponding inner surface 22*a* of sleeve 22, while head 39*a* of said sole protrudes slightly (on the order of 1 to 10 mm) beyond the surface (7, 17**, etc.) on which the pad is located.

It will be noted that near its base the sole may have a constriction 51 followed by a widened portion 52 forming a base (FIG. 4). These correspond closely with the matching shapes of the inner surface **22*a* of sleve 22**.

In addition, in order to protect it from damage, the periphery of head **39*a* of sole 39 may be inclined (30**).

Peripheral surface **22*b* of the sleeve is advantageously roughened (not shown) and locks against the corresponding surface (20*a*) of lodging 20. In this way, sleeve 22 (and thus pad 19) is held fast in lodging 20 when pulling force is exerted in the zone of contact formed by 39*a***.

It will be noted that pads 19 appear over at least the loading surface 7 of anel 2 (FIG. 1). However, it may also be advantageous to provide them on the surface opposite the loading surface 7 of upper panel 2 and on the bearing surface 17 of lower panel 12.

In the embodiment shown, panels 2, 12 include, respectively, a loading surface 7 and a bearing surface 17 in the shape of flat plates containing lodgings 20 for pads 19. On the underside of loading surface 7, lodgings 20 are formed in the surface of the ties of framework 3 that comes into contact with the forks of a forklift when the latter is carrying a pallet. When panels 2, 12 do not have surfaces 7, 17 in the shape of flat plates, lodgings 20 are formed in the loading and bearing surfaces of the ties making up the two frameworks.

Figure 3:
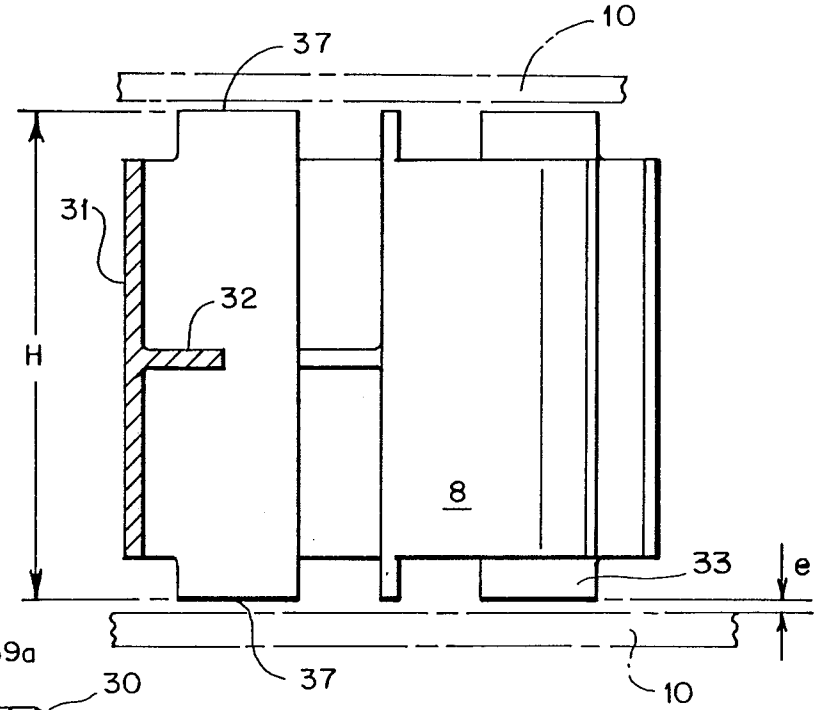
FIG. 3 is a side view, partially cut away, of said insert.
Figure 2:
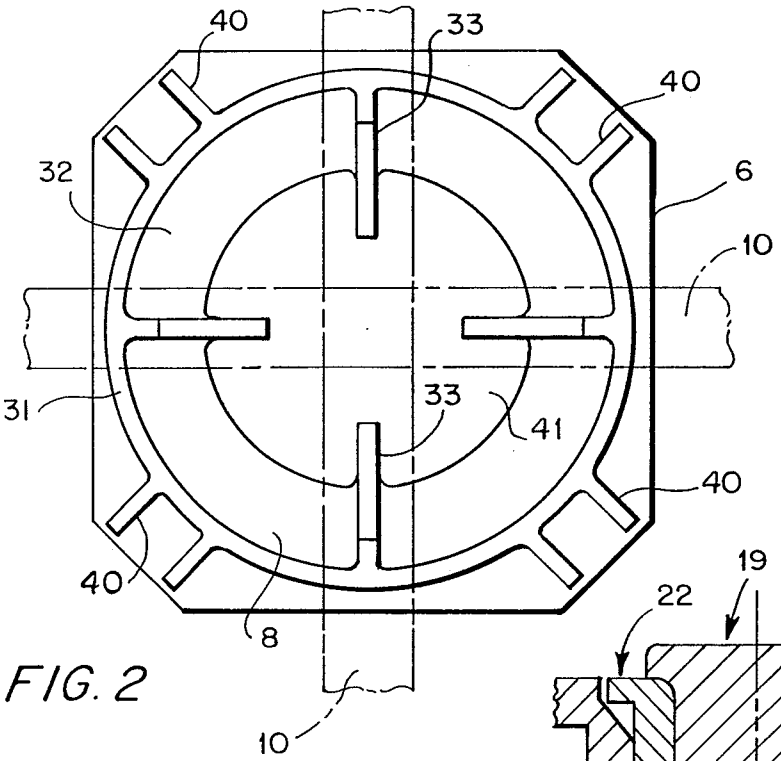
FIG. 2 is a top view of the insert positioned within a foot piece.

FIGS. 2 and 3 depict one of the inserts (8) whose essentially polygonal outer shape fits within a corresponding foot (6). Insert 8 is comprised of an outer wall 31 from which a peripheral rib 32 extends inward toward the hollow center 41 of the insert, several stiffeners 33 which protrude from the insert, and positioning means 40 which extend outward form wall 31 and which are shaped so as to match at least some of the inner surfaces of the polygonal recess formed by the corresponding feet. Positioning means 40, which may be four in number and which extend over the height of insert 8, may each have a cross-section in the form of a U, the ends of the legs of which enable insert 8 to be positioned against the four corresponding inner lateral surfaces of each of the pairs of feet (5–6, 15–16, etc.). For this purpose, positioning means 40 may be arranged at essentially 90° intervals.

When insert 8 is in place between two matching feet, a portion of it comes into contact with rods 10, which are lodged within channels 9 of upper and lower frameworks 3, 13, thus enabling said insert to fulfill its function as a shock absorber and load distributor. More specifically, and in the embodiment shown, stiffeners 33 are the elements which enter into more or less close contact with rods 10.

As an aid to understanding, installed rods 10 have been shown in broken lines. Thus in FIG. 2 there appear two intersecting stiffening rods 10, which might be arranged within lower framework 12. FIG. 3 shows two rods 10, one situated within upper framework 3 and the other in lower framework 13. Referring specifically to FIG. 2, it will be noted that the four stiffeners are arrayed essentially 90° apart, with two opposing stiffeners making contact with the same rod. It will also be noted that stiffeners 33 are found on wall 31 between peripheral positioning means 40. They protrude beyond insert 8, extending from wall 31 into the interior space formed in the center 41 of said insert.

In order to facilitate the relative positioning of insert 8 and rods 10, a small amount of space e is left between parts 8 and 10.

The process designed to reinforce the above-described pallet unfolds as follows.

In the course of a conventional process of molding the two panels 2, 12 of the pallet, at least some of ties 4, 14, 24, etc. of at least one of frameworks 3, 13 are provided with essentially perpendicular channels 9 intersecting in a single plane, through which are inserted, in a set order, reinforcing rods 10, some of which interlock at their intersections, at which points said rods may have cross-sections (e.g., in the form of notches) shaped so as to interlock.

More specifically, as shown in FIG. 1, where the reinforcements of the two panels 2, 12 are composed of four outer ties 4, 14, 24, 34 and a lateral center tie 44, reinforcing rods are inserted in the following sequence into channels 9 bored longitudinally within the corresponding ties. First, rod A is inserted into tie 24. next, rods B, C, and D are inserted in order into ties 34, 44, and 14, respectively. Rods B, C, and D lock rod A in place, especially rod B, which covers the end of rod A. Rod E is then inserted into tie 4, locking the preceding rods B, C, and D.

It is understood that the order in which the rods are inserted in each of the two panels is indicative and will depend on the structure of the framework used.

After rods 10 have been inserted, the open end of the channels may be close, e.g., by molding [a plug].

When the various bars 10 have been arranged in the appropriate channels, which are preferentially closed at one end, it is clear that only the open end of each channel, through which a rod was inserted, remains to be closed. Therefore, if each of the frameworks is composed of five ties, as presented above, and if each of said ties contains a longitudinal channel with only one opening, it is enough to close the five open ends after the rods have been inserted.

The next step is to position inserts 8 between the corresponding feet in such a way that positioning means 40 will be partially housed within the corresponding inner lateral surfaces of said feet. The two panels 2, 12 may then be welded together, e.g., using the known mirror process, at the interface between corresponding feet 5–6, 15–16, 25–26, etc. Of course, sufficient space must be provided to allow the operation to be performed under the best possible conditions. For this reason, the height H of inserts 8 is less than the total space available within the pairs of feet 5–6, 15–16, etc.

The foregoing produces a reinforced pallet with a rigid structure.

With respect to the installation of antiskid pads 19, sleeve 22, which forms a relatively rigid ring, is first molded. After cooling, pad 19 is fitted into sleeve 22, with the head of sole 39 extending slightly beyond said sleeve. This assembly is then inserted and locked into a corresponding lodging 20 on the pallet, with heat 39 of pad 19 protruding slightly from said lodging.

It is also possible for the wall of lodging 20 to contain a hole 21 which can be used to push worn pads 19 from their lodgings.

The invention is of course not limited to the embodiments illustrated and described herein. In particular, it would be possible for antiskid pad 19 to be constructed without rigid sleeve 22 and to consist solely of sole 39 (not shown). It would then be molded or force fitted directly into a lodging 20. One or more grooves might be provided in the lodging walls, with the pads becoming partially lodged within said grooves and thus locked in place.

What is claimed is:

1. Reinforced loading pallet comprising;

two essentially rectangular matching panels one superposed over the other, each panel having a rigid frame including ties equipped with hollow, polygonal feet arranged at at least four outer corners of the frame, at least some of the ties in at least one of the frames being provided with channels, at least some of the channels intersecting in a single plane;

rods inserted into some of the channels for reinforcing the pallet.

2. Reinforced loading pallet of claim 1 wherein the channels have open ends which are closed by plug means injection-molded into said channels.

3. Reinforced loading pallet of claim 2 wherein each of the reinforcing rods has a cross-section that is essentially a parallelopiped rectangle.

4. Reinforced loading pallet of claim 1 further comprising molded plastic inserts disposed between each of the feet on the frame of one panel and the corresponding feet on the frame of the matching panel.

5. Reinforced loading pallet of claim 4 wherein each of said inserts comprises:

an outer wall from which a peripheral rib extends inward toward the center of the insert;

several stiffeners which protrude from the insert; and positioning means which extend inward from said wall and which are shaped so as to match at least some of the inner surfaces of a recess formed by said feet.

6. Reinforced loading pallet of claim 1 further comprising antiskid pads formed over at least one outer surface of one of the panels and locked into matching lodgings having walls.

7. Reinforced loading pallet of claim 6 wherein each of said pads comprises a sole piece having a head protruding slightly from the surface over which the pad is distributed and a barrel held fast within an outer sleeve, with said sleeve locking against at least a portion of the walls of the lodging.

8. Reinforced loading pallet of claim 6 wherein said pads are distributed over both the upper and lower surface of the upper panel, and over the lower surface of the lower panel.

9. Reinforced loading pallet of claim 1 wherein at last some of the ties of at least one panel are bevelled so as to facilitate the insertion of forks of a forklift.

10. Process for reinforcing a molded plastic loading pallet having two essentially rectangular matching panels one superposed over the other, each panel including a rigid frame having ties equipped with hollow, polygonal feet arranged at at least four outer corners of the frame, the process comprising the steps of:

providing channels to at least a plurality of ties in at least one of the frames, at least a number of the channels intersecting in a single plane;

inserting rods into the channels in a set order for reinforcing the pallet, at least some of the rods locking together at their points of intersection.

* * * * *

UNITED STATES PATENT AND TRADEMARK OFFICE

CERTIFICATE OF CORRECTION

PATENT NO. : 4,735,154

DATED : April 5, 1988

INVENTOR(S) : Andre Hemery

It is certified that error appears in the above-identified patent and that said Letters Patent is hereby corrected as shown below:

Column 1, line 8, change "superposed" to --superimposed--.

Column 3, line 32, change "sleve" to --sleeve--.

Column 3, line 42, change "anel" to --panel--.

Column 3, line 62, change "form" to --from--.

Column 4, line 45, change "next" to --Next--.

Column 4, line 55, change "close" to --closed--.

Column 5, line 15, change "heat" to --head--.

Column 6, line 31, change "last" to --least--.

In the Abstract, line 5, after "ties" insert a comma (,).

In the Abstract, line 6, delete "(10)".

Signed and Sealed this

Eighteenth Day of April, 1989

*Attest:*

*Attesting Officer*

DONALD J. QUIGG

*Commissioner of Patents and Trademarks*